US010990061B2

(12) United States Patent
Kawasumi

(10) Patent No.: US 10,990,061 B2
(45) Date of Patent: Apr. 27, 2021

(54) IMAGE FORMING APPARATUS HAVING A DUCT FREE OF A FILTER AND A DUCT WITH A FILTER

(71) Applicant: CANON KABUSHIKI KAISHA, Tokyo (JP)

(72) Inventor: Ryoichi Kawasumi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/394,283

(22) Filed: Apr. 25, 2019

(65) Prior Publication Data

US 2019/0332053 A1 Oct. 31, 2019

(30) Foreign Application Priority Data

Apr. 26, 2018 (JP) ..... JP2018-084971

(51) Int. Cl.
*G03G 21/20* (2006.01)
*G03G 15/20* (2006.01)

(52) U.S. Cl.
CPC ..... *G03G 21/206* (2013.01); *G03G 15/2017* (2013.01)

(58) Field of Classification Search
CPC ..... G03G 21/206; G03G 15/2017
See application file for complete search history.

(56) References Cited

U.S. PATENT DOCUMENTS

2014/0056608 A1* 2/2014 Miura ..... G03G 15/2017 399/92
2017/0205765 A1* 7/2017 Mikami ..... G03G 15/2017
2018/0292782 A1* 10/2018 Nojima ..... G03G 21/206

FOREIGN PATENT DOCUMENTS

JP 2011-180340 A 9/2011

* cited by examiner

*Primary Examiner* — Walter L Lindsay, Jr.
*Assistant Examiner* — Geoffrey T Evans
(74) *Attorney, Agent, or Firm* — Venable LLP

(57) ABSTRACT

An image forming apparatus includes an image forming portion to form, at a first position, a toner image on a recording material using toner having a parting material, a fixing portion to fix, at a second position, an unfixed toner image formed on the recording material by the image forming portion, and a heat exhausting duct having an inlet between the first and second positions with respect to a recording material feeding direction to discharge air heated by the fixing portion, with the heat exhausting duct being free of a filter at the inlet thereof. In addition, a collection duct has an inlet between the first position and the second position to collect particles resulting from the parting material. The collection duct is provided with a filter at the inlet thereof, and the inlet of the collection duct is integrally molded with the inlet of the heat exhausting duct.

9 Claims, 6 Drawing Sheets

IMAGE FORMING APPARATUS HAVING A DUCT FREE OF A FILTER AND A DUCT WITH A FILTER

FIELD OF THE INVENTION AND RELATED ART

The present invention relates to an image forming apparatus such as a copying machine, a printer, a facsimileing machine, etc., which is for forming a toner image on a sheet of recording medium. It relates also to a multifunctional image forming apparatus having two or more functions of the preceding examples of image forming apparatus.

In an electrophotographic image forming apparatus, toner which contains a releasing agent is heated. As toner is heated, the releasing agent in the toner is also heated. As the releasing agent is heated, it turns into ultra fine particles (which are no more than 100 nm in diameter, and will be referred to as UFP or dust, hereafter). Thus, an electrophotographic image forming apparatus has been known to release ultra fine particles. In recent years, the regulation regarding the amount by which UFP is allowed to be released has become tighter and tighter. As examples of these regulations, "Blue angel", which is one of environmental regulations in European Union has been well known.

In recent years, image forming apparatuses having a mechanism for reducing the apparatus in the amount by which they release UFP have been increasing in number. One of the typical means for reducing an image forming apparatus in the amount by which it releases UFP is a filter for capturing UFP. More specifically, an image forming apparatus is provided with a duct through which the air which contains UFP is suctioned. It is also provided with the filter described above. The duct is positioned in the adjacencies of its fixing device, which is thought to be the primary source of the UFP. That is, the image forming apparatus is structured so that the air in the adjacencies of the fixing device is suctioned through the duct by a fan to capture the UFP in the air, in order to reduce the amount by which UFP is released from the apparatus (Japanese Laid-open Patent Application No. 2011-180340).

SUMMARY OF THE INVENTION

According to an aspect of the present invention, there is provided an image forming apparatus comprising an image forming portion configured to form, at a first position, a toner image on a recording material using toner comprising a parting material; a fixing portion configured to fix, at a second position, an unfixed toner image formed on the recording material by said image forming portion; a heat exhausting duct having an inlet between the first position and the second position with respect to a recording material feeding direction to discharge air heated by said fixing portion; and a collection duct having an inlet between the first position and the second position with respect to the recording material feeding direction to collect particles resulting from the parting material and having predetermined particle sizes, wherein said collection duct is integrally molded with said heat exhausting duct.

Further features of the present invention will become apparent from the following description of exemplary embodiments with reference to the attached drawings.

BRIEF DESCRIPTION OF THE DRAWINGS

FIG. 5 is an external perspective view of the combination shown in

FIG. 4.

DESCRIPTION OF THE EMBODIMENTS

Hereinafter, the present invention is described with reference to appended drawings and one of preferred embodiments of the present invention. If a given member, and a portion (portions) thereof, in one of the drawings are the same as those in the other drawings, they all are given the same referential codes, one for one.

(Image Forming Apparatus)

Figure 2:
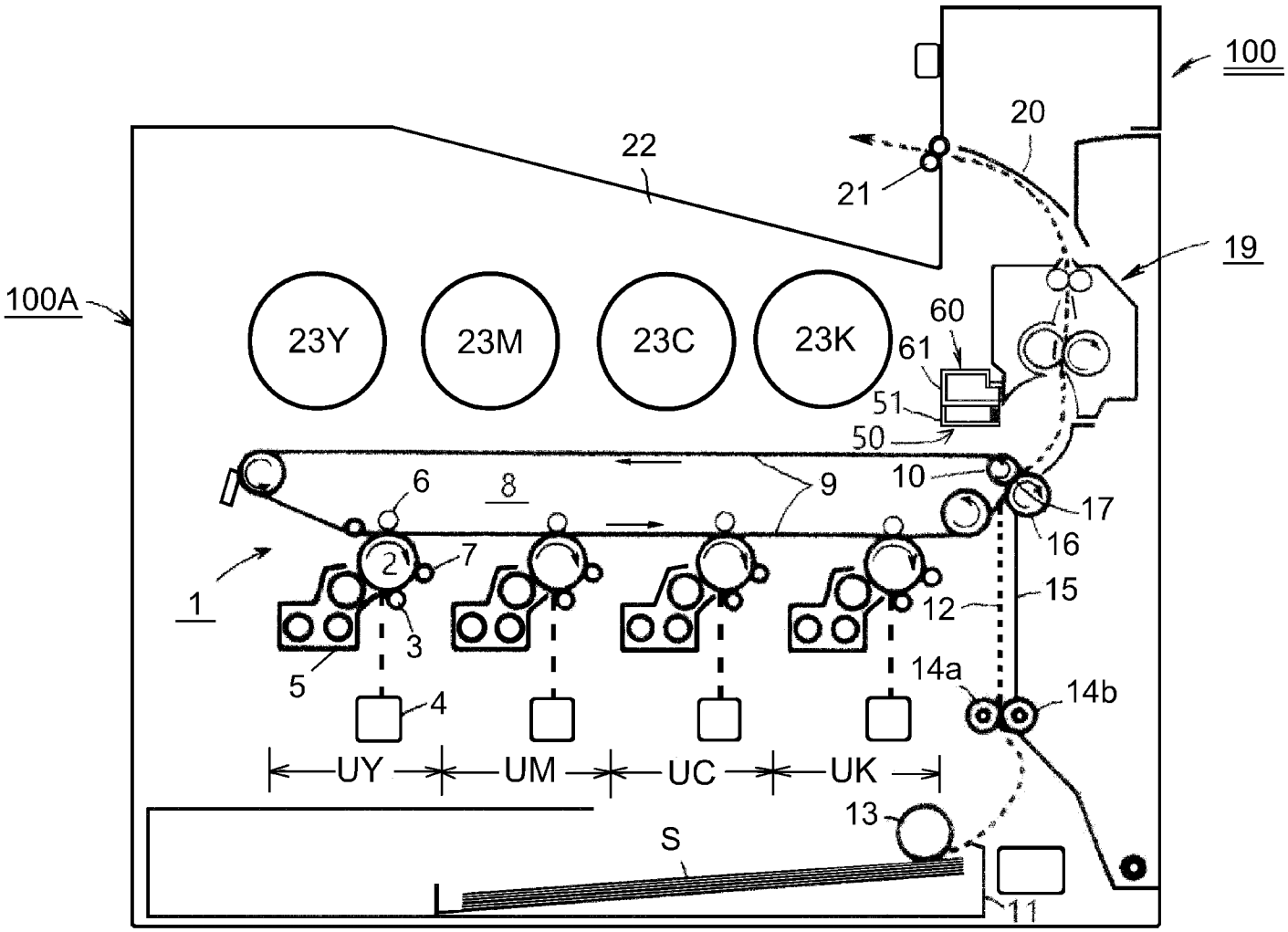
FIG. 2 is a schematic sectional view of one of typical image forming apparatuses to which the present invention is applicable; it shows the general structure of the apparatus.

FIG. 2 is a vertical sectional view of the image forming apparatus 100 in this embodiment, as seen from the front side of the apparatus. In the following description of the present invention, the front side of the image forming apparatus 100 is the same side as the front side of the sheet of recording paper, on which FIG. 2 is. The back side of the image forming apparatus 100 is the opposite side of the image forming apparatus 100 from the front side of the image forming apparatus 100. The left and right sides of the image forming apparatus 100 are the left and right sides as seen from the front side of the image forming apparatus 100. The top and bottom are the top and bottom with reference to the direction of gravity. The upstream and downstream are in terms of the sheet conveyance direction.

This image forming apparatus 100 is a full-color laser beam printer based on four primary colors. It uses one of electrophotographic processes. It is of the so-called tandem type. It is also of the so-called intermediary transfer type. It forms a toner image on a sheet S of recording medium based on the image information inputted into its control circuit portion from an external host apparatus (unshown) such as a personal computer.

An image forming portion 1, which is in the main assembly 100A (which hereafter may be referred to as apparatus frame, or apparatus main assembly) of the image forming apparatus 100, has four (first to fourth) image formation units U (UY, UM, UC and UK). Further, it has an intermediary transfer belt unit 8 and a sheet cassette 11, which are on the top and bottom sides of the combination of the first to fourth image formation units U.

The first to third image formation units U form yellow (Y), magenta (M) and cyan (C) images, respectively, which are the primary three colors in the so-called subtractive color mixing (generation). The fourth image formation unit U forms a black (K) toner image. Each image formation unit U has: an electrophotographic photosensitive member 2, as an image bearing member, which is in the form of a drum (which hereafter will be referred to as simply drum 2). It has also a charge roller 3, a laser scanner 4 (exposing device), a developing device 5, a primary transfer roller 6, and a drum cleaner 7, which are processing means for processing the drum 2.

By the way, for the sake of preventing the drawings from appearing cluttered, the referential suffixes for the image formation units UM, UC, and UK are not shown. Further, the electrophotographic image forming operation of an image forming portion 1 having these image formation units UY, UM, UC and UK and intermediary transfer unit 8 is well-known. Therefore, it is not described here.

The above-mentioned yellow (Y), magenta (M), cyan (C) and black (K) toner images are sequentially transferred in layers (primary transfer) onto the intermediary transfer belt 9 from the drums 2 of the first to fourth image formation units U, while the intermediary transfer belt 9 is circularly moved. As a result, a multicolor toner image is formed of the yellow (Y), magenta (M), cyan (C) and black (K) images layered upon the intermediary transfer belt 9.

The image forming apparatus 100A is provided with a sheet conveyance passage 12, which is in the right portion of the interior of the apparatus main assembly 100A, and through which a sheet S of recording medium is conveyed upward from the bottom side of the apparatus main assembly 100A. Further, it is provided with a sheet feeder roller 13, a pair of registration rollers 14*a* and 14*b*, a second transfer roller 16, a fixing device 19 (fixing apparatus), and a pair of discharge rollers 21, which are positioned in the listed order along the sheet conveyance passage 12, starting from the bottommost one. Further, it is provided with a belt suspension roller 10, which is on the right side of the intermediary transfer belt unit 8. The secondary transfer roller 16 is kept pressed against this belt suspension roller 10 by a preset amount of force, with the placement of the belt 9 between the roller 10 and secondary transfer roller 16, forming thereby the secondary transfer nip 17 (first position) between itself and belt 9.

As the feed roller 13 is driven with a preset control timing, the sheets (of recording medium such as paper) are introduced one by one into the sheet conveyance passage 12 while being separated from the rest of the sheets. Then, each sheet S of recording medium is delivered to the secondary transfer nip 17 with preset control timing, by the pair of registration rollers 14*a* and 14*b*, and is conveyed through the secondary transfer nip 17 while remaining pinched between the belt 6 and secondary transfer roller 16. While the sheet S is conveyed through the secondary transfer nip 17, the four toner images, which are different in color and are layered on the belt 9, are transferred together (secondary transfer) onto the sheet S.

After the sheet S of recording medium is conveyed out of the secondary transfer nip 17, it is introduced into the fixing device 19, in which the four toner images are fixed to the sheet S. The fixing device 19 is a fixing portion, which fixes the toner images on the sheet S, in the secondary transfer nip 17 (first position) of the image forming portion 1. After the sheet S is conveyed out of the fixing device 19, it is discharged, as a finished print, into a delivery tray 22 by the pair of discharge rollers 21. By the way, the delivery tray 22 is a part of the top wall of the apparatus main assembly 100A.

Referential codes 23Y, 23M, 23C and 23K stand for toner bottles, one for one, in which replenishment toners for the developing devices 5 of the first to fourth image formation units UY, UM, UC and UK, respectively, are stored. These bottles are removably installable in the apparatus main assembly 100A. More specifically, they are removably installable in the adjacencies of the top side of the intermediary transfer unit 8. Each of developing devices 5 of the image formation units UY, UM, UC and UK is supplied as necessary with a proper amount of toner by the corresponding toner bottle by a toner delivery mechanism (unshown).

(Fixing Device)

Figure 1:
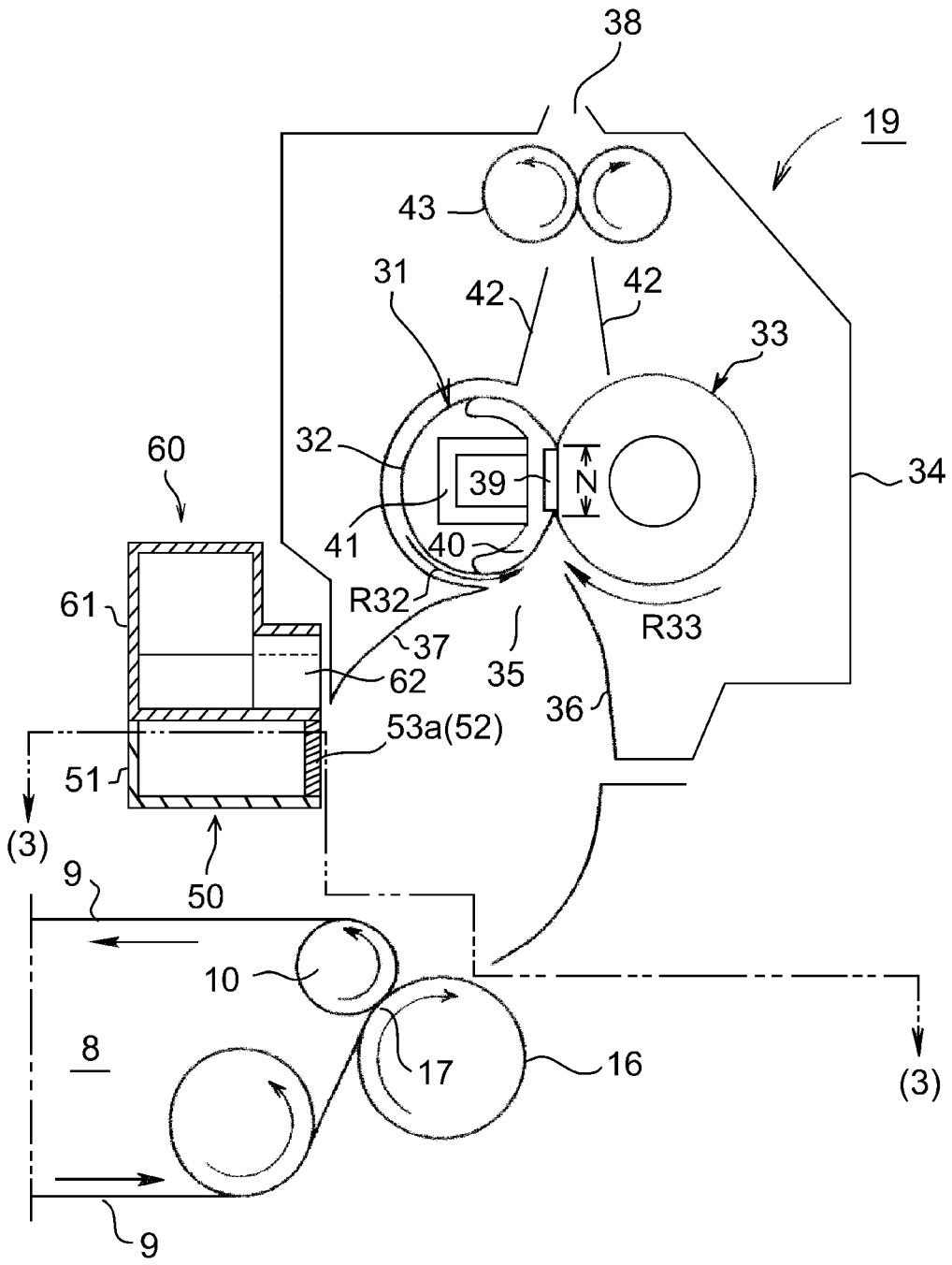
FIG. 1 is an enlarged sectional view of the portions of the image forming apparatus shown in FIG. 2, which are related to the present invention.

FIG. 1 is an enlarged, schematic, and vertical sectional view of a combination of the secondary transfer nip portion, fixing device 19, and their adjacencies in FIG. 2. The fixing device 19 in this embodiment is of the so-called on-demand type (ODF). It is also of the so-called belt heating type. It is structured so that its pressing member is driven. The basic structure and fixing operation of this type of fixing device are well-known, and therefore, are only briefly described here.

Roughly speaking, this fixing device 19 comprises a belt unit 31, a pressure roller 33, and a casing 34. The belt unit 31 is the first rotational member of the fixing device 19. It has a fixation belt 32 (which hereafter may be referred to simply as belt). The pressure roller 33 is the second rotational member of the fixing device 19. It is elastic. The fixation belt 32 and pressure roller 33 are contained in the casing 34. The fixation nip N, which fixes the toner images with the use of heat and pressure while a sheet S of recording medium, on which the toner images are, is conveyed through the fixation nip N.

The casing 34 has a sheet entrance 35 (sheet introduction opening) and a sheet exit 38. The sheet entrance 35 is made up of the first and second guiding members 36 and 37. The first guiding member 36 is the one that faces the back surface of a sheet S of recording medium, that is, the surface of the sheet S, which does not bear a toner image. The second guiding member 37 is the one that faces the front surface of the sheet S, that is, the surface which bears a toner image. The belt unit 31 and pressure roller 33 are positioned so that the sheet entrance 35 is positioned below the sheet exit 38 in terms of the gravity direction. The fixing device 19 in this embodiment is structured so that it conveys a sheet S of recording medium upward from its bottom side. It is called a vertical path fixing device.

The fixing device 19 is provided with a fixation heater 39 (heat source, which hereafter is referred to simply as heater), a heater holder 40 (which hereafter will be referred to simply as heater), a rigid stay 41 (which hereafter will be referred to simply as stay), etc., which are disposed on the inward side of the loop (belt loop) which the belt 32 of the belt unit 31 forms.

The heater 39 is the heat source for heating the belt 32. It is also a pressing member for pressing the belt 32 toward the pressure roller 33. As the heater 39, the so-called ceramic heater, for example, is used. The heater 39 is positioned in such an attitude that its lengthwise direction is parallel to the widthwise direction of the belt 32. Further, it is positioned on the inward side of the loop which the belt 32 forms, in such a manner that the belt 32 slides on the heater 39 by its inward surface, with reference to the loop (belt loop) which the belt forms.

As electric power is supplied to the heater 39 from a power source (unshown), the heater 39 generates heat, and quickly increases in temperature. The temperature of the heater 39 is detected by a temperature sensor (unshown), and is fed back to the control circuit portion (unshown). Based on the information regarding the detected temperature of the heater 39, the control circuit portion controls the power supply to the heater 32 from the power source, in such a manner that the temperature of the heater 39 increases to a preset target level, and remains at the target level.

The holder 40 is such a member that holds the heater 39 in such a manner that its lengthwise direction is parallel to the lengthwise direction of the heater 39. It holds the heater 39 on its surface which faces the pressure roller 33. Further, it is a guiding member which guides the belt 32 in such a manner that the belt 32 maintains a preset amount of curvature for causing a sheet S of recording medium to easily separate from the belt 32. The holder 40 is desired to be excellent in heat resistance. As the material for the holder 40, a liquid polymer resin, for example, can be used.

The stay 41 is a supporting member for supplying the combination of the holder 40 and heater 39 in such a manner that its lengthwise direction is parallel to the lengthwise direction of the combination. The stay 41 is positioned on the opposite side of the combination of holder 40, heater 39, and belt 32 from the pressure roller 33. It is under the pressure applied to its lengthwise end portions toward the pressure roller 33.

Since the fixing device 19 is structured as described above, the combination of the stay 41, holder 40, and heater 39 keeps the belt 32 pressed toward the pressure roller 33. As the belt 32 is pressed upon the pressure roller 33, the elastic rubber layer of the pressure roller 33 is elastically deformed in such a manner that is conforms in shape to the surface of the heater 39, forming thereby the fixation nip N having a preset width in terms of the sheet conveyance direction, between the belt 32 and pressure roller 33.

The pressure roller 33 is disposed so that its rotational axis (lengthwise direction) is practically parallel to the widthwise direction of the belt 32. It is rotatably held by the front and rear plates of the casing 34, by the lengthwise ends of its metallic core, with the placement of a pair of bearings between the metallic core and the front and rear plates of the casing 34, one for one.

The metallic core of the pressure roller 33 is in connection to a driving mechanism (unshown) which includes a motor as a driving force source. It is rotationally driven by the motor in the clockwise direction indicated by an arrow mark R33 at a preset peripheral velocity. The belt 32 is sandwiched by the pressure roller 33 and the combination of the heater 39 and holder 40, in the fixation nip N. Thus, the driving force is transmitted from the pressure roller 33 to the belt 32 by the friction between the pressure roller 33 and belt 32 in the fixation nip N. Therefore, the belt 32 is rotated in the counterclockwise direction indicated by an arrow mark R32 by the pressure roller 33.

As the pressure roller 33 is being rotationally driven, and the temperature of the heater 39 is kept at the target level to which it has been increased, a sheet S of recording medium, on which an unfixed toner image was formed in the second transferring portion 17 (first position) of the image forming portion 1, is conveyed to the fixing device 19. Then, the sheet S is made to enter the fixing device 19 through the sheet entrance 35, and is conveyed through the fixation nip N (second position) while remaining pinched by the belt 32 and pressure roller 33.

In this embodiment, the fixing device 19 is above the intermediary transfer belt 9 in terms of the gravity direction, and the fixation nip N is above the secondary transfer nip 17 in terms of the gravity direction. Therefore, as the sheet S comes out of the secondary transfer nip 17, it is conveyed upward, and is introduced into the fixing device 19 from the underside of the fixing device 19.

While the sheet S is conveyed through the fixation nip N, remaining pinched between the belt 32 and pressure roller 33, the heat from the heater 39 is given to the sheet S and the unfixed toner image(s) thereon through the belt 32. Thus, the unfixed toner image(s) is melted by the heat from the heater 39, and is fixed to the sheet S by the pressure in the fixation nip N. As the sheet S comes out of the fixation nip N, it goes through the gap between the pair of sheet guides 42. Then, it is moved out of the fixing device 19 through the sheet exit 38 by way of the pair of discharge rollers 43 of the fixing device 19. Then, the sheet S is sent to the delivery tray 22 by the discharge rollers 21 by way of the guiding member 20.

(Process of UFP Generation)

Next, how the UFP (dust) generates from the releasing agent in toner is described. The fixing device 19 fixes a toner image by placing the belt 32, which is a high temperature fixing member, in contact with a sheet S of recording medium and the toner image thereon. In a case where an unfixed toner image is fixed to the sheet S with the use of a fixing device structured as described above, it occurs sometimes that while the unfixed toner is fixed to the sheet S, parts of the toner of which the unfixed toner image is formed, transfer onto (adhere to) the belt 32. This phenomenon is referred to as "offset phenomenon", hereafter. The offset phenomenon is one of the causes of the image defects. Therefore, there has to be a measure to deal with this phenomenon.

Generally speaking, the toner to be used by an image forming apparatus contains wax as a releasing agent. Thus, as this type of toner is heated, the wax in toner particles melts and oozes out. Therefore, as a toner image formed of this type of toner is fixed, the outward surface of the belt 32 is covered with melted wax. As the surface of the belt 32 is covered with the wax, the releasing properties of the wax makes it more difficult for the toner to adhere to the surface of the belt 32.

By the way, in this embodiment, not only pure wax, but also, chemical compounds having wax-like molecular structure are referred to as wax. For example, chemical compounds which resulted because of the reaction between the molecules of the resin, of which toner is made, and wax molecules having hydrocarbon chains or the like, are also referred to as wax. As the releasing agent, one of the substances such as silicon oil having releasing properties may be used in place of wax.

As wax melts, parts of it gasifies (volatilizes). This phenomenon is thought to occur because wax molecules are not uniform in size. That is, wax contains low molecular components which are short in chain length, and low in boiling point, and also, high molecular components which are longer in chain length and higher in boiling point. Therefore, it is thought that the low molecular components which are low in boiling point are gasified before the high molecular components. As the gasified wax is cooled in the air, it turns into microscopic particles of certain sizes, more specifically, micro-particles which are between several nanometers to several hundreds of nanometer (most micro-particles are thought to be several nanometers to several tens of nanometer in diameter). These microscopic particles are the UFP described above.

The UFP generates through the process described above, it is evident that the primary culprit which generates UFP is the fixation nip N, which applies heat to the wax. Further, because of the belt rotation, positioning of the heater 39, etc., it is on the upstream side of the fixation nip N that the belt temperature becomes highest. Therefore, it is reasonable to think that it is also on the upstream side of the fixation nip N that the UFP is generated by the largest amount. Moreover, UFP generates from the toner image on a sheet S of recording medium. Therefore, it is evident that UFP generates across the entirety of the portion of the fixation nip N, which corresponds to the image formation range of the sheet S of recording medium in terms of the lengthwise direction of the fixing device 19.

(Structural Arrangement for UFP Reduction)

Next, the structural arrangement for reducing the fixing device 19 in the amount by which it discharges UFP is described. As for a means for reducing the amount by which UFP is discharged from the apparatus main assembly 100A, it is common practice to provide the apparatus main assembly 100A with a filter and an air-suctioning device so that the UFP generated by the fixing device 19 can be captured by the filter. As for the positioning of the filter, the filter is to be positioned in the upstream adjacencies of the fixation nip N, which is the largest in the amount of UFP generation. It is evident from the process of UFP generation described that if air can be suctioned evenly across the entirety of the filter in terms of the lengthwise direction of the fixing device 19, UFP can be most efficiently captured.

Figure 3:
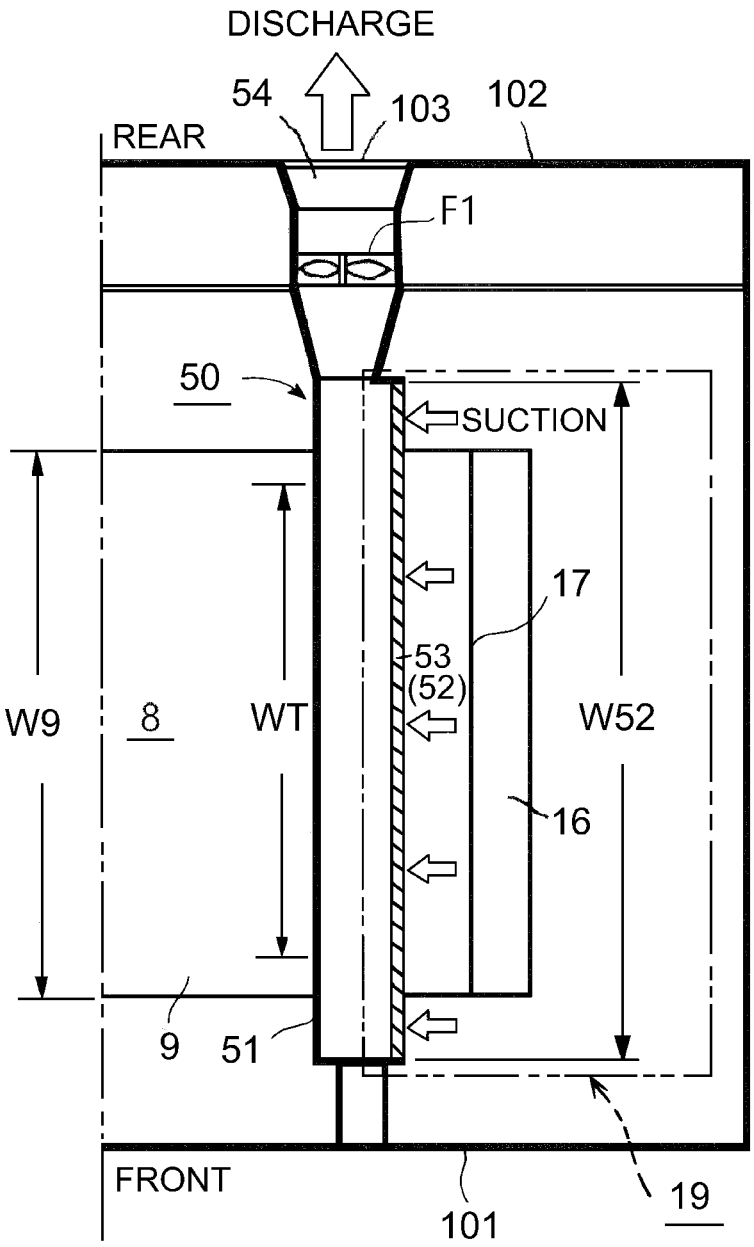
FIG. 3 is a schematic sectional view of the image forming apparatus, at a plane indicated by the two-dot line (3)-(3).

In each of the appended drawings, a referential code 50 stands for a duct unit for reducing the amount by which UFP is discharged from the image forming apparatus 100 in this embodiment. FIG. 3 is a schematic sectional view of the fixing device 19 at planes indicated by arrow mark (3)-(3). The duct unit 50 is between the secondary transferring portion 17 (first position) of the image forming portion 1 and the fixation nip N (second position) of the fixing device 19. It has a duct 51 and a fan F. The duct 51 has an intake port 52, and an exhaust port 54 which is provided with a filter 53 for capturing (filtering) UFP (particles attributable to releasing agent), and through which the air in the apparatus main assembly 100A is exhausted. The fan F is for generating airflow in the duct 51.

The duct 51 in this embodiment is a hollow member which is rectangular (square) in cross section. It is positioned so that its lengthwise direction is parallel to the lengthwise direction of the fixing device 19. The intake port 52 is an opening of the duct 51. That is, the intake port 52 extends in the direction parallel to the lengthwise direction of the fixation nip N. The filter 53 is attached to the duct 51 in a manner to cover the intake port 52. That is, the filter 53 is a flat and rectangular member, and is fixed to the intake port 52 so that its lengthwise direction is perpendicular to the sheet conveyance direction.

One (front end) of the duct 51 is blocked, and the other end (rear end: downstream end in terms of airflow) is open as the exhaust port 54. The fan F1 (first fan) is positioned close to the exhaust port 54, in the duct 51. The fan F1 is under the control of a control circuit portion (unshown). As the fan F1 is driven, the air in the duct 51 is exhausted through the exhaust port 54. Thus, external air in suctioned into the duct 51 through the intake port 52 which is covered with the filter 53.

The duct 51 is placed in the apparatus main assembly 100A, being in a preset position between the front and rear plates 101 and 102, respectively, of the apparatus main assembly 100A, being supported by supporting members (unshown), with its front and rear sides being on the front and rear plate sides, respectively. The exhaust port 54 which is the rear end portion of the duct 51 is in alignment with an opening 103 (air passage) with which the rear plate 102 is provided.

The duct 51 is between the secondary transferring portion 17 and fixation nip N, being on the belt unit side of the fixing device 19 (closer to first rotational member 32 having heat source 39), because placing the duct 51 close to the heat source 39 which volatilizes wax places the duct 51 close to the UFP source, promising that UFP is more effectively captured, as described above. However, placing the duct 51 on the pressure roller 33 side, that is, away from the heat source, is not advantageous from the standpoint of capturing UFP only in relative term. That is, even if the duct 51 is placed on the pressure roller 33 side, the UFP can be satisfactorily effectively captured.

The intake port 52 covered with the filter 53 of the duct 51 is positioned closer to the fixation nip N than the central point between the secondary transferring portion 17 and fixation nip N. Further, it is positioned in the adjacencies of the fixation nip N. That is, the intake port 52 covered with the filter 53 is disposed in the adjacencies of the upstream side of the fixation nip N.

As the fan F1 is driven, the duct unit 50 structured as described above suctions the air, which is between the secondary transferring portion 17 and fixation nip N and contains UFP, into the duct 51 (recovery duct) while filtering the air with the filter 53, through the intake port 52 covered with the filter 53. After the removal of UFP from the air by the filter 53, the air is exhausted out of the apparatus main assembly 100A through the exhaust port 54 and opening 103. That is, the amount by which UFP is exhausted out of the image forming apparatus 100 is reduced by this duct unit 50.

Referring to FIG. 3, the intake port 52 has a preset length in terms of the direction perpendicular to the sheet conveyance direction. Thus, it is assured that the UFP which is traceable to the wax which has transferred onto the belt 32 from the toner image on a sheet S of recording medium, is captured across the entire range of the belt 32 in terms of the widthwise direction of the belt. Also referring to FIG. 3, a referential code W52 stands for the length of the intake port 52, and a referential code WT stands for the portion of a sheet S of recording medium, across which an image can be formed (maximum image width: width of largest image formable on sheet S). A referential code W9 stands for the width of the intermediary transfer belt 9. The width W52 of the intake port 52 is set to be greater than the widest image width WT).

By the way, in a case where an image forming apparatus is enabled to use two or more types of sheets of recording medium, in terms of width, all that has to be done is to structure the apparatus to satisfy an inequity (W52>WT) when sheets S of recording medium, which are highest in the frequency of usage are in use. In a case where a sheet S of recording medium which is narrowest is used, the length W52 of the intake port 52 may be set to satisfy (W52>WT) based on the maximum image width T for the narrowest sheet S of recording medium. That is, the length W52 of the intake port 52 is such length that is equal to the maximum image width WT on the narrowest sheet S of recording medium usable by the apparatus.

Further, in a case where the widest sheet S of recording medium is highest in the frequency of usage, it is possible to set the length W52 of the intake port 52 to satisfy: W52>WT, based on the maximum image width WT for the widest sheet of recording medium. That is, the length W52 of the intake port 52 is equal to the maximum image width WT for the widest sheet S of recording medium usable with the apparatus 100.

Further, referring to FIG. 1, not only is the intake port 52 positioned near the belt 32, but also it is positioned so that it faces a sheet S of recording medium as the sheet S enters the fixing device 19. Positioning the intake port 52 as described above makes it possible to reduce the duct unit 50 in size. That is, not only is the intake port 52 placed near the belt 32 which is the dust source, but also, it is positioned so that it faces the sheet S. Therefore, it is unnecessary to provide the duct unit 50 with the passage through which air is to be guided from the fixation nip N to the intake port 52. Therefore, it is easier to reduce the duct unit 50 in overall size.

The fan F1 which is for suctioning the air, which contains the UFP, into the duct 51 is fixed to the outward end of the duct 51. Therefore, the filter 53, duct 51, and fan F1 are positioned as close as possible; the passage through which the air which contains UFP is suctioned is made as short as possible.

Further, the filter 53 is positioned so that it extends in the lengthwise direction of the intake port 52 of the duct 51. Therefore, the upstream and downstream sides of the duct 51 are practically equal in the pressure loss attributable to the presence of the filter 53, and therefore, the duct 51 is uniform in the suction by the fan F1 through the filter 53, in terms of the lengthwise direction. That is, the duct 51 is practically uniform, in terms of the lengthwise direction of the intake port 52, in the amount by which the air is suctioned through the filter 53.

By positioning the filter 53, duct 51, and fan F1 as described above, it is possible to make the entirety of the fixing area of the fixation nip N practically uniform in the amount by which the air is pulled through the filter 53. Therefore, it is evident that the entire range of the fixing range of the fixation nip N can be made practically uniform in the amount by which the UFP attributable to the toner image on a sheet of recording medium can be captured.

Further, optimally positioning the filter 53, duct 51, and fan F1 as described above makes it possible to reduce the fan F1 in the amount of force it has to generate to suction the air, and therefore, to reduce the fixation nip N in cost and size.

As described above, positioning the filter 53, duct 51, and fan F1 as shown in FIGS. 1, 2, and 3 which are sectional views of the fixing device 19, makes it possible to provide a highly efficient means for reducing an image forming apparatus in the amount by which it releases UFP, which is lower in cost and smaller in size than any conventional electrophotographic image forming apparatus.

(Structure of Guiding Member)

Figure 6:
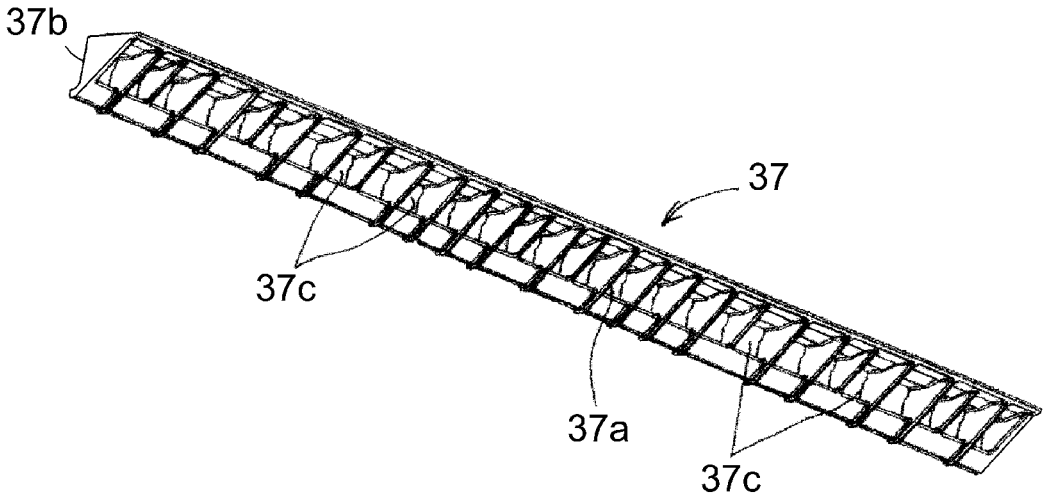
FIG. 6 is an external perspective view of the guiding member of the apparatus.

FIG. 6 is an external perspective view of the guiding member 37 which is on the front side of the intake port 52 (opening) of the duct unit 50. The guiding member 37 in this embodiment is molded of heat resistant resin. It is fixed to a preset portion of the casing 34 as if it were an integral part of the casing 34. The guiding member 37 has the first surface 37*a* (by which sheet S is guided). It has also the second surface 37*b* (back surface), which is the opposite surface from the first surface 37*a*. Further, it has an air passage (gap) which allows the air to flow from the first surface side to the second surface side.

The guiding member 37 is provided with multiple air passages 37*c* which are through holes which extend from the first surface side to the second surface side. That is, the guiding member 37 is provided with multiple through holes, which are in alignment with each other in terms of the lengthwise direction of the guiding member 37. That is, the guiding member 37 is disposed so that its lengthwise direction is parallel to the lengthwise direction of the fixation nip N. The air passages 37 are in alignments with each other in the direction parallel to the guiding member 37.

The duct 51 of duct unit 50 is disposed on the second surface 37*b* side of the guiding member 37 so that the intake port 52 covered with the filter 53 of the duct 51 roughly squarely faces the second surface 37*b* of the guiding member 37. Therefore, as the fan F1 is driven, the duct unit 50 can suction the air, which is between the secondary transferring portion 17 and fixation nip N and contains UFP, into the duct 51 through the air passage 37*c* of the guiding member 37, while filtering the air with filter 53.

As described above, causing the airflow which flows through the filter 53, to pass the air passage 37*c* of the guiding member 37 makes it possible to guide a sheet S of recording medium, without reducing the fixing device 19 in the efficiency with which is can capture the UFP. Further, it is effective to make it difficult for the airborne toner particles to adhere to the filter 53.

(Structure of Heat Exhaustion Duct of Main Assembly)

Next, the airflow passage structured to exhaust the heat within the main assembly of the image forming apparatus 100 is described.

The image forming portion 1 in the apparatus main assembly has the first to fourth image formation units U (UY, UM, UC and UK) as described above.

Each image formation unit U contains the toner for forming a toner image. Since an electrophotographic image forming apparatus is designed to melt toner with the use of heat, it may be said that it is susceptible to temperature increase in its main assembly. For example, it has been known that if its interior temperature increases high enough to exceed the melting point of toner, the particles of the toner in the image formation unit U melt and agglomerate, making it impossible to properly form a toner image (image formation unit U forms unsatisfactory image). Moreover, if the internal temperature increase of the apparatus main assembly substantially exceeds the melting point of toner, it is possible that the toner in the image formation unit U will solidify, making it impossible for the image formation unit U to operate.

Therefore, it may be said that exhausting the heat within the apparatus main assembly, in particular, the heat in the adjacencies of the image forming portion 1, is extremely important to allow the apparatus main assembly to properly operate.

As the heat source which causes the adjacencies of the image forming portion 1 to increase in temperature, the power source for driving the image formation unit U or the like can be listed. However, the primary heat source which contributes to this phenomenon is the fixing device 19, because the fixing device 19 is designed to give to a sheet S of recording medium, the heat for melting a toner image on the sheet S, as described above, and therefore, the fixing device 19 releases to its adjacencies, the most of the heat, which it generated, but, was not used for heating the sheet S.

Therefore, it is desired to provide the adjacencies of the fixing device 19, in particular, the adjacencies of the fixation nip N, with an airflow passage through which heat can be exhausted out of the apparatus main assembly. Further, it may be said that the proper position for placing the airflow passage is the upstream adjacencies of the fixation nip N, which is also the border between the fixation nip N and image forming portion 1.

This requirement for the positioning of the airflow passage is roughly the same as that for the filter for capturing the UFP. Therefore, these two, that is, the combination of filter for capturing the UFP and dust, and the duct for exhausting the internal heat of the apparatus main assembly, have to be properly positioned in the upstream adjacencies of the fixation nip N without interfering with the functions of the image forming apparatus 100.

(Positioning of UFP Capturing Dust, and Heat Exhaustion Dust)

As for the positioning of the UFP capturing duct and heat exhaustion duct, which satisfies the requirements described above, it is possible to position one of the ducts on the left side of the sheet conveyance passage, and the other on the right side. However, the two ducts have to be positioned to guide their internal airflow out of the apparatus main assembly. Thus, the two ducts which are similar in structure to each other have to be positioned in the two different areas, one for one, which sandwich the sheet conveyance passage. In other words, this positioning of the two ducts takes up a substantial space in the apparatus main assembly, or requires to form the two ducts so that they conform in size and shape to the space available in the apparatus main assembly for the positioning.

As another design for the duct positioning, it is possible to make the UFP capturing duct double as the heat exhaustion duct. This design, however, is improper from the stand point of capturing the UFP and exhaustion of the internal heat, because this design requires for the airflow for heat exhaustion to be exhausted through the filter 53, being therefore disadvantageous since the filter interferes the heat exhaustion airflow. Moreover, if the fan F1 is increased in the amount of airflow enough to effectively exhaust the internal heat, the resultant amount of airflow is different from the optimal amount of airflow for capturing the UFP.

Thus, in order to properly position the UFP capturing duct and heat exhaustion duct to satisfactorily capture the UFP and satisfactorily exhaust the internal heat, it is desired that the two ducts are positioned on the same side of the sheet conveyance passage, without being made to double as each other.

Figure 4:
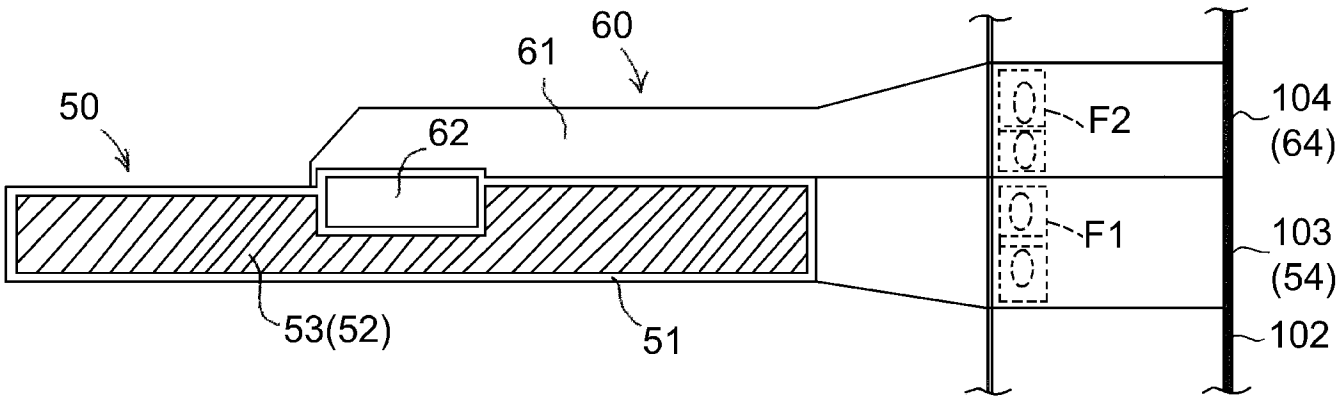
FIG. 4 is a side view of a combination of the UFP reduction duct unit and heat exhaustion duct unit of the image forming apparatus, as seen from the right-hand side of the apparatus.
Figure 5:
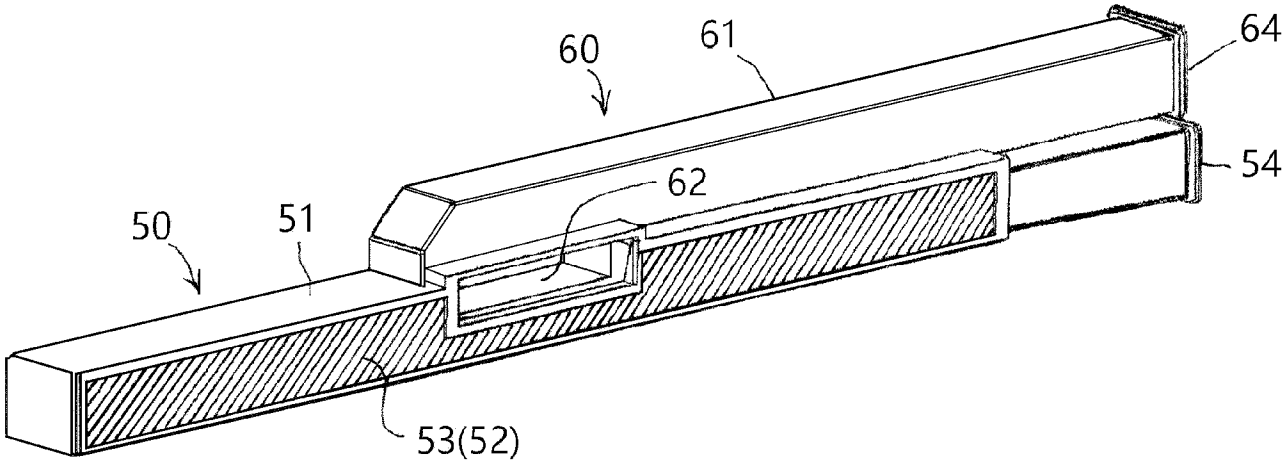

In this embodiment, the requirements described above was met by positioning the two ducts as shown in FIGS. 1, 4 and 5.

FIG. 4 is a schematic side view of the UFP reduction duct unit 50 as seen from the sheet conveyance side, that is, the right-hand side of the apparatus main assembly. FIG. 5 is a perspective view of the duct units 50 and 60 shown in FIG. 4.

The duct unit 50 is provided with an intake port 62 for exhausting the internal heat of the apparatus main assembly. The intake port 62 is an integral part of the top portion of the center portion of the intake port 52 (second intake port 52) of the duct unit 50. Further, the duct unit 50 is provided with a duct unit 60 for exhausting the internal heat of the apparatus main assembly. The duct unit 60 is in connection to the intake port 62. The duct unit 60 is provided with a duct 61 (second duct) which includes a portion which is in connection to the intake port 62, an exhaust port 64 which is one end of the duct 61, and a fan F2 (second fan) for generating airflow in the duct 61 like the fan F1.

Therefore, the hot air in the adjacencies of the fixation nip N is suctioned into the duct unit 60 through the intake port 62, and is exhausted out of the apparatus main assembly, without going through the filter 53, by way of the duct 61, exhaust portion 64, an the opening 104 with which the rear plate 102 is provided.

Because of the structural arrangement described above, it is possible to position the heat exhaustion duct unit 60 next to, and in parallel to, the UFP capturing duct unit 50 which is shorter and smaller than any conventional heat exhaustion duct unit. Therefore, the heat exhaustion duct also is shorter and smaller than any conventional one.

By the way, the intake port 62 of the heat exhaustion duct unit 60 is roughly the same as the filter 53 in the requirement regarding its positioning. Therefore, from the standpoint of maximizing them in size, they are desired to be formed integral to each other. However, the duct 61 and exhaust port 64, which are the downstream portions of the duct unit 50, do not need to be integral parts of the duct unit 50; they may be independent from the duct unit 50. Further, in this embodiment, the intake port 62 is positioned above the center portion of the filter 53. However, it does not need to be positioned in an area which corresponds in position to the center of the filter 53, and/or an area above the filter 53. That is, they may be positioned at the lengthwise ends of the filter 53, or sequentially positioned in terms of the lengthwise direction of the filter 53, based on the amount of airflow generated by the fan.

As described above in detail, the present invention makes it possible to provide a combination of a highly efficient means for reducing an image forming apparatus in the amount by which it discharges UFP, and an airflow passage for exhausting heat from within the main assembly of an image forming apparatus, which is lower in cost and smaller in size than any conventional combination of the UFP discharge reducing means, and airflow passage for exhausting heat from within the main assembly of an apparatus.

«Miscellanies»

1) In the foregoing, the present invention was described with reference to one of the preferred embodiments of the present invention. However, the embodiment is not intended to limit the present invention in scope. For example, the present invention is also applicable to a fixing device which employs a heat roller, or a fixing device which employs a heating method based on electromagnetic induction.

2) The intake port 52 may be disposed on the pressure roller side with reference to the sheet conveyance passage.

3) Each of Fans F1 and F2 may be a cross-flow fan or a blower fan.

4) In the preceding embodiment, the image forming apparatus 100 was a multifunction printer having two or more drums 2. However, the present invention is also applicable to a fixing device which is employable by a monochromatic multifunction printer, or a single function printer, which has only one drum 2. That is, the choice for an image forming apparatus which is compatible with a fixing device which is in accordance with the present invention is not limited to a multifunction printer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-084971 filed on Apr. 26, 2018, which is hereby incorporated by reference herein in its entirety.

What is claimed is:

1. An image forming apparatus comprising:

an image forming portion configured to form, at a first position, a toner image on a recording material using toner comprising a parting material;

a fixing portion configured to fix, at a second position above the first position in a vertical direction, an unfixed toner image formed on the recording material by said image forming portion;

a heat exhausting duct having an inlet between the first position and the second position in the vertical direction to discharge air heated by said fixing portion, said heat exhausting duct being free of a filter at said inlet thereof, and said inlet of said heat exhausting duct having an opening area; and a collection duct having an inlet between the first position and the second position in the vertical direction to collect particles resulting from the parting material and having predetermined particle sizes, said collection duct being provided with a filter at said inlet thereof, and said inlet of said collection duct having an opening area, the opening area of said collection duct being larger than the opening area of said inlet of said heat exhausting duct, wherein said inlet of said collection duct is integrally molded with said inlet of said heat exhausting duct and said inlets of said heat exhausting duct and said collection duct are disposed so as to oppose the unfixed toner image formed on the recording material.

2. The apparatus according to claim 1, further comprising a filter provided adjacent to an outlet of said heat exhausting duct.

3. The apparatus according to claim 2, further comprising a fan configured to produce an air flow in said heat exhausting duct, and a fan configured to produce an air flow in said collection duct.

4. The apparatus according to claim 1, wherein said heat exhausting duct is disposed substantially at a central position with respect to a longitudinal direction of said fixing portion.

5. The apparatus according to claim 4, wherein said collection duct is disposed at each end positions with respect to the longitudinal direction of said fixing portion.

6. The apparatus according to claim 5, wherein said collection duct is disposed at a central position in the longitudinal direction so as to be juxtaposed with said heat exhausting duct in the vertical direction.

7. An image forming apparatus comprising:

(a) an image forming portion configured to form, at a first position, a toner image on a recording material using toner comprising a parting material;

(b) a fixing portion configured to fix, at a second position above the first position in a vertical direction, an unfixed toner image formed on the recording material by said image forming portion; and (c) a horizontally elongated duct including:

(i) a first inlet where particles resulting from the parting material and having predetermined particle sizes are collected by a filter, said first inlet having an opening area; and (ii) a second inlet where air heated by said fixing portion is sucked without passing through a filter, said second inlet having an opening area, the opening area of said first inlet of said duct being larger than the opening area of said second inlet of said duct, wherein said first inlet and said second inlet are positioned at a position between the first position and the second position in the vertical direction and positioned to oppose the unfixed toner image formed on the recording material, and wherein said first inlet is disposed at each end position of said duct in a horizontal direction and said second inlet is disposed at a central position of said duct in a horizontal direction.

8. The apparatus according to claim 7, further comprising a fan configured to produce an air flow in said duct.

9. The apparatus according to claim 7, wherein said first inlet is disposed at the central position so as to be juxtaposed with said second inlet in the vertical direction.

* * * * *